US006959651B2

(12) United States Patent
Li

(10) Patent No.: US 6,959,651 B2
(45) Date of Patent: Nov. 1, 2005

(54) RUNNER FOR EXTENSION TABLE

(76) Inventor: Tseng-Jung Li, No. 303, Tzyh Li 1st Road, Kaohsiung (TW)

( * ) Notice: Subject to any disclaimer, the term of this patent is extended or adjusted under 35 U.S.C. 154(b) by 178 days.

(21) Appl. No.: 10/639,054

(22) Filed: Aug. 11, 2003

(65) Prior Publication Data

US 2005/0034639 A1 Feb. 17, 2005

(51) Int. Cl.[7] ..... A47B 1/00
(52) U.S. Cl. ..... 108/83
(58) Field of Search ..... 108/83, 89, 143, 108/88, 87; 384/17

(56) References Cited

U.S. PATENT DOCUMENTS

| | | | | |
|---|---|---|---|---|
| 122,946 | A * | 1/1872 | Henkel | 108/83 |
| 949,119 | A * | 2/1910 | Gruender | 108/83 |
| 1,040,028 | A * | 10/1912 | Schultz | 108/83 |
| 2,414,959 | A * | 1/1947 | Lowe | 108/83 |
| 2,548,469 | A * | 4/1951 | De Gaal | 108/83 |
| 3,042,468 | A * | 7/1962 | Rudow et al. | 108/83 |
| 3,099,232 | A * | 7/1963 | Cooper | 108/83 |
| 3,336,882 | A * | 8/1967 | Edelson | 108/83 |
| 3,337,274 | A * | 8/1967 | Green | 108/83 |
| 6,336,743 | B1 * | 1/2002 | Wang | 108/83 |

* cited by examiner

*Primary Examiner*—Jose V. Chen
(74) *Attorney, Agent, or Firm*—Dellett & Walters

(57) ABSTRACT

A runner for an extension table that has two sliding leaves includes a wooden primary transverse beam with a side, a wooden secondary transverse beam attached securely to the side of the primary transverse beam and a track assembly attached to the side of the primary transverse beam. The secondary transverse beam has a top. The track assembly is supported by being fitted on the top of the secondary transverse beam. Therefore, the secondary transverse beam provides a robust support to the track assembly to prevent that from being deformed or separated when the track assembly undergoes an accumulated weight caused by stacking the extension tables during a period of transport or storage.

3 Claims, 4 Drawing Sheets

RUNNER FOR EXTENSION TABLE

BACKGROUND OF THE INVENTION

1. Field of the Invention

The present invention relates to a runner for an extension table, and more particularly to a runner that provides a reliable and robust support for leaves of the extension table.

2. Description of Related Art

Extension tables comprise sliding leaves and runners for the leaves. A runner of an extension table in accordance with the prior art has a track assembly for supporting slidably the sliding leaves. However, when the extension tables are transported or stored, the extension tables will be stacked one on top of another to save space. Thus, the bottom one of the stacked extension tables suffers the accumulated weight of the stacked extension tables. Long-term accumulated weight loaded on the bottom extension table will damage the track assembly of the bottom table, such as deforming the track assembly or loosening a combination of the track assembly. In such a situation, the sliding leaves will not slide smoothly on the runner and the track assembly should be replaced with a new one to fix the aforesaid problem for the runner.

To overcome the shortcomings, the present invention provides a runner for an extension table to mitigate or obviate the aforementioned problems.

SUMMARY OF THE INVENTION

The main objective of the invention is to provide a runner for an extension table, and the runner has a strengthened structure to support slidably leaves of the extension table to prevent the runner from being damaged during a period of transport or storage.

Other objectives, advantages and novel features of the invention will become more apparent from the following detailed description when taken in conjunction with the accompanying drawings.

DETAILED DESCRIPTION OF PREFERRED EMBODIMENT

Figure 1:
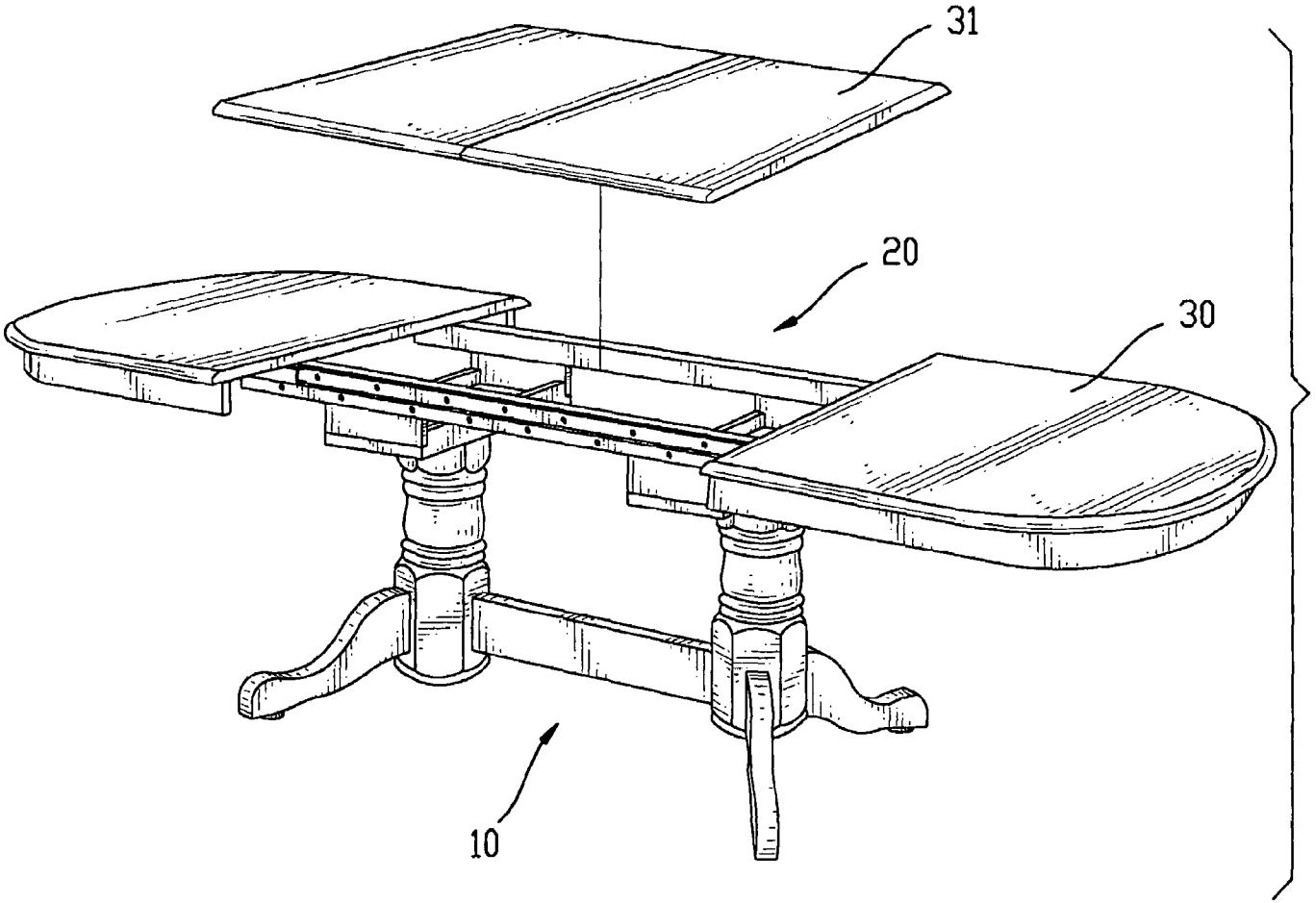
FIG. 1 is an exploded perspective view of an extension table with a runner in accordance with the present invention.
Figure 2:
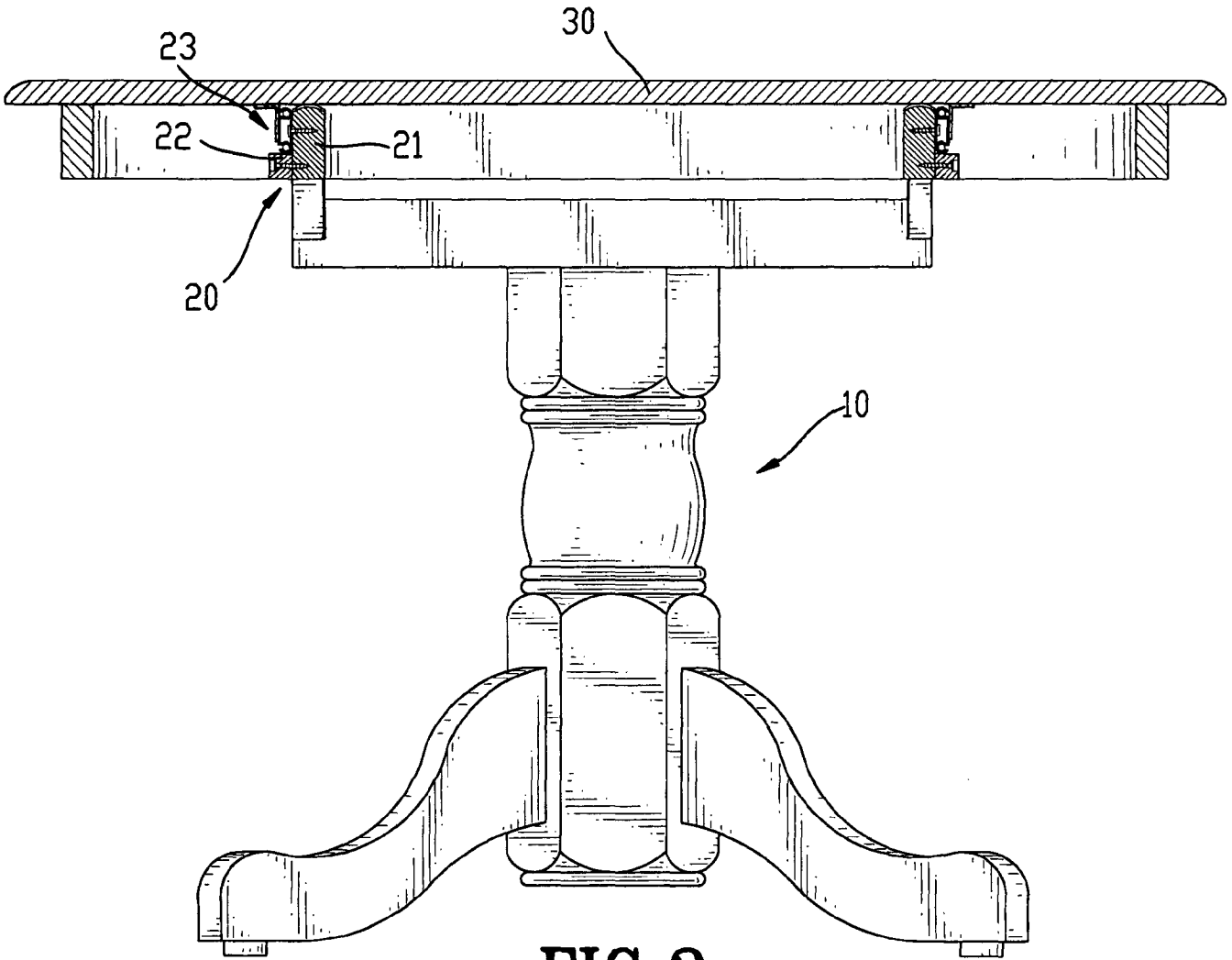
FIG. 2 is a side plan view in cross section of the extension table in FIG. 1.

With reference to FIGS. 1 and 2, an extension table (not numbered) comprises a leg assembly (10), two runners (20), two sliding leaves (30) and multiple removable leaves (31). The runners (20) are respectively mounted on ends of the leg assembly (10) and located opposite to each other. The sliding leaves (30) are slidably attached to the runners (20) and can be abutted with and separated from each other. The removable leaves (31) are mounted on the runners (20) between the sliding leaves (30) for an extension of the table.

Figure 3:
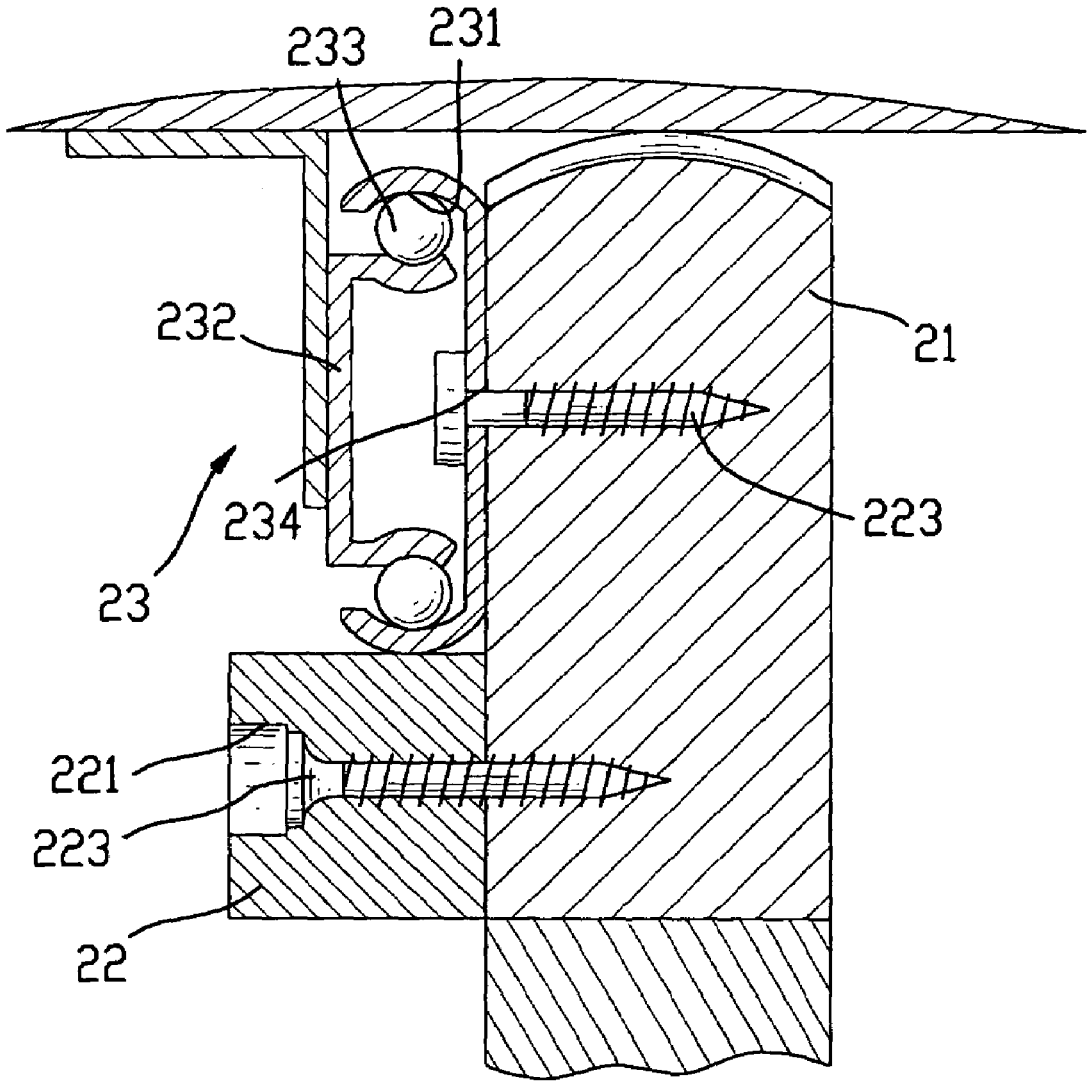
FIG. 3 is an enlarged cross sectional view of the runner in FIG. 1.
Figure 4:
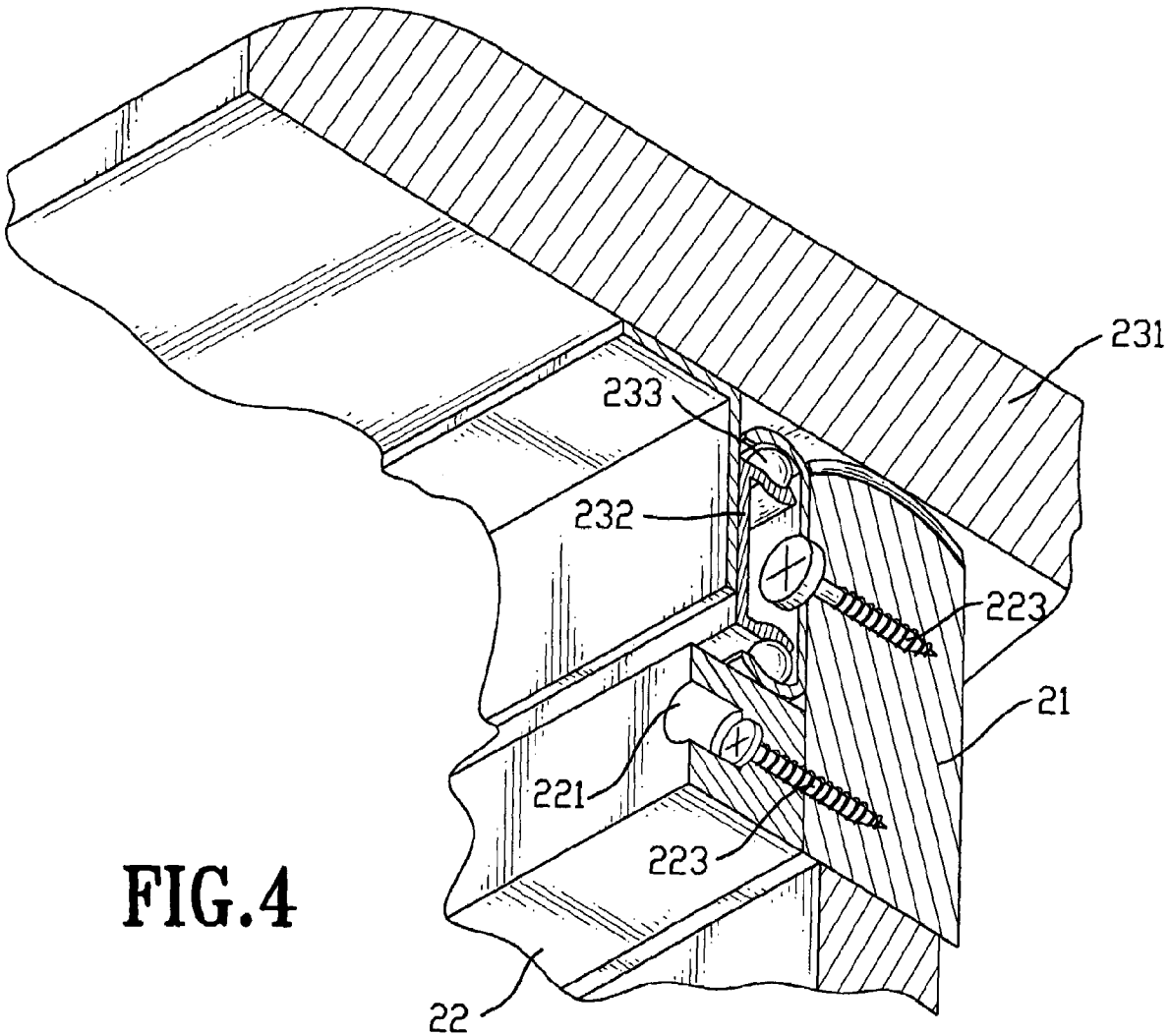
FIG. 4 is an enlarged perspective view in cross section of the runner in FIG. 3.

With reference to FIGS. 2 to 4, the runner (20) in accordance with the present invention comprises a primary transverse beam (21), a secondary transverse beam (22) and a track assembly (23). The primary transverse beam (21) is made of wood and is transversely mounted on the leg assembly (10). The primary transverse beam (21) has a side (not numbered).

The secondary transverse beam (22) is made of wood, is attached securely to the side of the primary transverse beam (21) and has a top (not numbered) and multiple holes (221). Each hole (221) receives a fastener, such as a tapping screw (223) that screws into the secondary transverse beam (22), extends out of the secondary transverse beam (22) and screws into the primary transverse beam (21) to fasten the primary and secondary transverse beams (21, 22) together. Adhesive is used to stick the primary and secondary transverse beams (21, 22) together before the tapping screws (223) fasten them together.

The track assembly (23) is conventional and is attached to the side of the primary transverse beam (21). The track assembly (23) has a stationary track (231), a sliding track (232) and multiple rollers, such as rolling balls (233). The stationary track (231) is attached to the side of the primary transverse beam (21) and has a bottom (not numbered) and multiple holes (234). Each hole (234) in the stationary track (231) receives a fastener, such as a tapping screw (223) as previously described. The bottom of the stationary track (231) abuts exactly the top of the secondary transverse beam (22). Thereafter, the secondary transverse beam (22) provides a robust support to the track assembly (23) to prevent the track assembly (23) from being deformed by an accumulated weight during a period of transport or storage.

The sliding track (232) is slidably mounted in the stationary track (231) and connects to the sliding leaves (30). The rolling balls (233) are mounted intermediately between the stationary track (231) and the sliding track (232) to provide a capability of the sliding track (232) sliding in the stationary track (231).

Consequently, as the primary and secondary transverse beams (21, 22) are both made of wood, the adhesive can firmly stick them together and cooperate with the fasteners to effectively fix them together. The track assembly (23) will not be damaged by the accumulated weight caused by stacking the extension tables for being conveniently transported or stored. The sliding leaves (30) can be separated smoothly to extend the table with the removable leaves (31). The extension tables with the runners in accordance with the present invention will become durable and convenient for use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A runner for an extension table having two sliding leaves and the runner comprising:

a primary transverse beam having a side;

a secondary transverse beam attached securely to the side of the primary transverse beam and having a top; and a track assembly attached to the side of the primary transverse beam and having a stationary track attached to the side of the primary transverse beam and having a bottom abutting the top of the secondary transverse beam; and a sliding track mounted slidably in the stationary track to connect to one of the sliding leaves of the extension table.

2. The runner for the extension table as claimed in claim 1, wherein the primary transverse beam is made of wood, the secondary transverse beam is made of wood and further has multiple holes, the stationary track further has multiple holes, and each of the holes of the secondary transverse beam and the stationary track receives a fastener to fasten the secondary transverse beam and the stationary track with the primary transverse beam.

3. The runner for the extension table as claimed in claim 2, wherein the fasteners are tapping screws.

* * * * *